United States Patent [19]

Yavor

[11] 4,059,894

[45] Nov. 29, 1977

[54] CAULKING GUN CARTRIDGE OPENING TOOL

[76] Inventor: Stanley Yavor, 209 Jackson St., Berwick, Pa. 18603

[21] Appl. No.: 717,123

[22] Filed: Aug. 24, 1976

[51] Int. Cl.[2] ..... B26B 27/00

[52] U.S. Cl. ..... 30/296 A; 7/14.1 A; 30/152; 30/359; 30/408

[58] Field of Search ..... 30/359, 296 A, 296 R, 30/366, 152, 408, 443; 7/1 B, 14.1 R, 14.1 A, 16

[56] References Cited

U.S. PATENT DOCUMENTS

| | | | |
|---|---|---|---|
| 418,613 | 12/1889 | Gourd | 7/14.1 R |
| 539,130 | 5/1895 | Haynes | 30/408 X |
| 592,538 | 10/1897 | Cole | 30/296 A X |
| 597,345 | 1/1898 | Welsh | 7/1 B |
| 637,048 | 11/1899 | Toulotte | 7/14.1 R |
| 817,717 | 4/1906 | Kottas | 7/14.1 R |
| 852,614 | 5/1907 | Person | 7/14.1 R |
| 1,127,609 | 2/1915 | Feyrer | 30/152 X |
| 1,803,899 | 5/1931 | Fuller | 30/296 A X |
| 2,186,430 | 1/1940 | Richter | 7/14.1 R |
| 2,795,043 | 6/1957 | Fleischer | 30/296 A X |

*Primary Examiner*—Gary L. Smith
*Assistant Examiner*—J. T. Zatarga
*Attorney, Agent, or Firm*—Robert D. Farkas

[57] ABSTRACT

This disclosure pertains to a caulking gun cartridge opening tool having a flat knife-like blade adapted with a spring mounting clip at one end thereof. A needle-like rod is pivotably secured at one end to the blade and is stored there-against when not in use. A sharpened edge of the blade is utilized to cut the plastic tip at the dispensing end of the cartridge. The needle-like rod may be used to pierce the plastic cap or to break through crusted layers of caulking material when rotated outwardly from the storage position thereof. The mounting clip facilitates storage of the apparatus on a caulking gun.

6 Claims, 3 Drawing Figures

CAULKING GUN CARTRIDGE OPENING TOOL

BACKGROUND OF THE INVENTION

1. The Field of the Invention

This invention relates to cutting and piercing tools and more particularly to that class utilized in cutting and piercing cylindrical plastic protrusions associated with caulking gun cartridges.

2. Description of the Prior Art

The prior art abounds with cartridge tip cutting devices. U.S. Pat. No. 3,105,614 issued on Oct. 1, 1963 to W. A. Sherbondy and U.S. Pat. No. 3,189,226 issued on June 15, 1965 to W. A. Sherbondy disclose caulking gun apparatus each having a shearing knife operated by the trigger of the dispensing gun parallel to a portion of the handle of the apparatus containing an opening. In use, the tip of the cartridge is first inserted in the hole or opening and as the trigger apparatus is manually operated, the tip is sheared away.

The 1965 patent further teaches a spring member having a free pointed end used to bias the trigger apparatus arcuately outwardly from the handle and serving as a piercing tool to either puncture the plastic cylinder at the dispensing end of the cartridge or to break into a crusted layer of caulking material thereat.

Both of the aforementioned patents suffer the common deficiency of situating the opened portion of the dispensing end of the cartridge in contact with the caulking gun apparatus, thereby causing portions of the gun to become soiled with the caulking material extruding outwardly from the cartridge.

SUMMARY OF THE INVENTION

A primary object of the present invention is to provide a cartridge opening tool which can both sever or pierce portions of the cylindrical caulking dispensing tube affixed to one end of a caulking cartridge.

Another object of the present invention is to provide a cartridge opening tool which is removably affixed to a cartridge dispensing gun.

Still another object of the present invention is to provide a cartridge opening device which when operated will not soil body contacting portions of the gun.

Yet another object of the present invention is to provide a cartridge piercing and shearing tool which may be utilized in conjunction with existing cartridge dispensing guns and readily adapted to be removably mounted thereupon.

Caulking cartridges, adapted for use with piston type caulking guns, employ a cylindrical or conical tapered dispensing tip tip at the discharge end of the cartridge. The tip is sealed and kept in a sealed condition until such time that the cartridge is ready for use. The present invention is attached to the gun utilizing a spring dip convolution affixed at one end of a flattened cutting blade. The user may operate the cutting blade against the tip severing a portion of it from the cartridge when the present invention is attached to or removed from the caulking gun. The elongated needle-like rod, pivotably affixed to the cutting blade, may be similarly operated whilst piercing the outermost end of the tip or a crust formation of caulking material sealing a previously opened tip. The active parts of the present invention may be cleaned after use so as to maintain the gun in an unsoiled condition whilst the user thereof employs the gun.

These objects as well as other objects of the present invention, will become more readily apparent after reading the following description of the accompanying drawings.

DESCRIPTION OF THE PREFERRED EMBODIMENT

The structure and method of fabrication of the present invention is applicable to an elongated metallic plate having one marginal edge thereof tapered so as to form a knife-like edge. A portion of the plate adjacent thereof is folded back against a first lateral surface of the plate and is convoluted so as to have an S-shape, forming a clamping clip thereby. The folded back clip portion is fabricated from a material possessing spring-like characteristics allowing the user to "clip" the apparatus to portions of a caulking gun or to be carried about clipped to shirt pockets or tool carriers or the like. If desired, the folded back portion may be reduced in width.

An elongated needle-like rod, having a shorter length than the second lateral surface of the plate, is affixed to the plate utilizing a ball and socket arrangement adjacent the end carrying the folded back clip portion. The rod may be stored parallel to the second lateral surface and is pivoted outwardly therefrom when the rod is in a use position. The free end of the rod may be blunt or pointed facilitating its use as a piercing tool.

Figure 1:
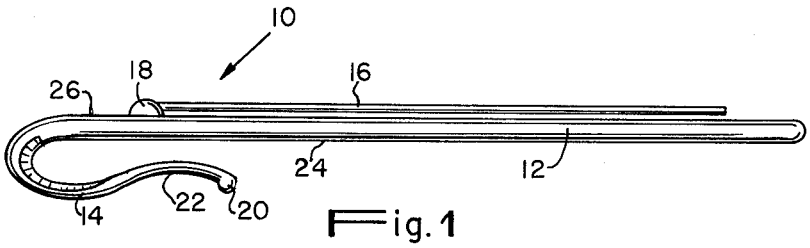
FIG. 1 is a side elevation view of the present invention.

Now referring to the figures, and more particularly to the embodiment illustrated in FIG. 1 showing the present invention 10 having a plate portion 12 and a clip portion 14. Kneedle-like rod 16 is pivotably secured at a ball and socket joint 18 to the plate portion 12. Clip portion 14 has a general S-like shape and is adapted with a blunt-like free end 20 and a clamping portion 22 most closely located to the lowermost lateral surface 24 of plate portion 12. Ball and socket joint 18 is located on lateral surface 26.

Figure 2:
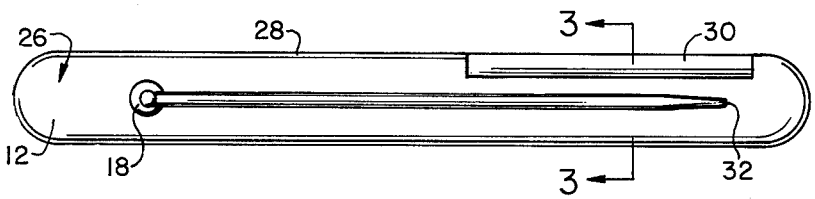
FIG. 2 is a plan view of the present invention.

FIG. 2 shows plate portion 12 having marginal edge 28 thereof adapted with a knife edge portion 30. Needle-like rod 16 is shown mounted in ball and socket joint 18 which in turn is located on surface 24. End 32 of needle-like rod 16 is shown having a pointed shape. Needle-like rod 16 is illustrated in a stored position lying against surface 26. Needle-like rod 16 may be pivoted upwardly away from surface 16 or positioned angularly from the location shown.

Figure 3:
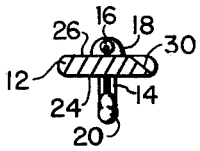
FIG. 3 is an end view of the present invention.

FIG. 3 illustrates blunt end 20 of spring clip 14 having a narrow width extending below lateral surface 24.

One of the advantages of the present invention is a cartridge opening tool which can both sever or pierce portions of the cylindrical caulking dispensing tube affixed to one end of a caulking cartridge.

Another advantage of the present invention is a cartridge opening tool which is removably affixed to a cartridge dispensing gun.

Still another advantage of the present invention is a cartridge opening device which when operated will not soil body contacting portions of the gun.

Yet another advantage of the present invention is a cartridge piercing and shearing tool which may be utilized in conjunction with existing cartridge dispensing guns and readily adapted to be removably mounted thereupon.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A caulking gun cartridge opening tool comprising an elongated plate, a portion of one marginal edge of the plate having a knife-like edge, a portion of the plate adjacent one end thereof being disposed folded into an S-shape extending substantially parallel to a first lateral surface of the plate, a needle-like rod, one end of the rod having a ball-like shape, a socket, said socket fixedly secured to a second lateral surface of the plate, said ball-like shape being partially captured in said socket the length of the rod being shorter than the length of the plate.

2. The caulking gun cartridge opening tool as claimed in claim 1 wherein the free end of the rod is tapered to a point.

3. The caulking gun cartridge opening tool as claimed in claim 1 wherein the S-like shape portion of the plate is fabricated from a material possessing spring characteristics.

4. The caulking gun cartridge opening tool as claimed in claim 1 wherein said socket is located adjacent said one end of the plate.

5. The caulking gun cartridge opening tool as claimed in claim 1 wherein the width of the S-like shape portion of the plate is narrower than the width of the remaining portions of the plate.

6. The caulking gun cartridge opening tool as claimed in claim 1 wherein the free end of the S-like shape portion of the plate is blunted.

* * * * *